US007152280B1

(12) United States Patent
Taylor

(10) Patent No.: US 7,152,280 B1
(45) Date of Patent: Dec. 26, 2006

(54) SANITIZER NAPKIN HOLDER

(76) Inventor: Lysandra Taylor, 1656 Claudine Dr., St. Louis, MO (US) 63138

( * ) Notice: Subject to any disclaimer, the term of this patent is extended or adjusted under 35 U.S.C. 154(b) by 107 days.

(21) Appl. No.: 10/885,540

(22) Filed: Jul. 7, 2004

(51) Int. Cl.
*A45F 5/04* (2006.01)

(52) U.S. Cl. ..... 24/7; 224/494

(58) Field of Classification Search ..... 24/7, 24/9; 224/217
See application file for complete search history.

(56) References Cited

U.S. PATENT DOCUMENTS 3,965,591 A 6/1976 Le Sueur
4,494,718 A 1/1985 Clay
5,487,924 A 1/1996 Fritze
5,803,249 A * 9/1998 Harsanyi et al. ..... 206/494
6,126,009 A * 10/2000 Shiffler et al. ..... 206/494
6,164,441 A * 12/2000 Guy et al. ..... 206/494
6,767,604 B1 * 7/2004 Muir et al. ..... 206/494

* cited by examiner

*Primary Examiner*—Robert J. Sandy
(74) *Attorney, Agent, or Firm*—Crossley Patent Law; Mark A. Crossley

(57) ABSTRACT

A napkin holder, specifically a sanitizer napkin holder which includes a pre-moistened towellette contained within the flexible ring-shaped napkin holder. The napkin ring may be torn away from a napkin along a perforated line. A pull-tab is provided to access the pocket containing the pre-moistened towellette, and a tear line is provided for further opening the pocket for even easier access to the towellette within.

9 Claims, 3 Drawing Sheets

SANITIZER NAPKIN HOLDER

BACKGROUND OF THE INVENTION

1. Field of the Invention

This invention relates to the field of napkin holders and more specifically to a sanitizing napkin holder.

2. Description of the Prior Art

Napkins are offered at virtually all restaurants and usually at home and are often contained within napkin rings. The prior art offers examples of napkin rings:

U.S. Pat. No. 5,487,924 to Fritze discloses a decorative napkin ring with various renditions of its decorative applications. It does not discuss cleansing or sanitation in association therewith.

U.S. Pat. No. 4,494,718 to Clay discloses a napkin holder of a material such that a napkin can be inserted and arranged within a choice of configurations without its intersecting shafts. There is no reference to or association with cleansing or sanitation.

U.S. Pat. No. 3,965,591 to Le Sueur discloses a napkin ring fitted with magnetic means for attaching an identifying name or initials.

While the above-described devices fulfill their respective and particular objects and requirements, they do not describe a sanitizer napkin holder that provides for the advantages of the present invention, namely cleansing and sanitation. As further explanation:

It was often customary some years ago to place a finger bowl at each place setting, for hand cleansing before a meal. Although that is seldom practice today, it served a viable purpose. Hands are carriers of bacteria and germs. Our hands come in contact with others when we shake hands, or just touch the chair that we pull out before a meal.

Touching doorknobs, money, public phones or any object that has been handled by others' hands can spread germs and bacteria. Today, we have become more conscious than ever of sanitation. We often, then, make a trip to the washroom to cleanse hands before and after eating.

Therefore, a need exists for an improved napkin holder, particularly one that includes a sanitizing pre-moistened towellette. In this respect, the present invention substantially departs from the conventional concepts and designs of the prior art.

SUMMARY OF THE INVENTION

In view of the foregoing disadvantages inherent in the known types of napkin rings now present in the prior art, the sanitizer napkin holder overcomes the above-mentioned disadvantages and drawbacks or the prior art. As such, the general purpose of the sanitizer napkin holder, described subsequently in greater detail, is to provide a sanitizer napkin holder which has all of the advantages of the prior art mentioned heretofore and many novel features that result in an improved napkin holder which is not anticipated, rendered obvious, suggested, or even implied by the prior art, either alone or in combination thereof.

The present invention comprises a sanitizer napkin holder, specifically a napkin holder comprised of a ring of flexible material and containing a pocket within. In the preferred embodiment, the sanitizer napkin holder is about 1 inch in diameter and 1½ inch in width. The holder is in a ring shape but also has a perforated line separation for complete separation into an elongated substantially flat strip, if desired. It can thereby be tearably removed from a napkin or, if desired, left intact and the napkin pulled out. The holder has a moisture proof pocket that contains a sanitizing pre-moistened towellette within. The pocket substantially circumscribes the majority of the napkin holder and is readily accessible by way of a pull-tab. A tear line is also featured which may substantially circumscribe the outer lateral borders of the pocket. In another embodiment, the tear line may be limited to an initial section of the pocket in proximity to the pull-tab. In the primary embodiment, therefore, a user may either utilize the entire tear line to access the pre-moistened towellette within, or they may merely pull the tab and tear back a portion of the pocket opening, then pull the towellette out.

The towellette within, in the preferred embodiment, is saturated with a cleansing liquid that is antibacterial, a disinfectant, and anti-fungal. By offering these sanitizing features, users are afforded disease protection. Further, the towellette negates trips to a washroom to prepare for eating or drinking. This feature is an additional recognizable benefit to parents who now do not have to usher children to a washroom prior to eating. Also, the towellette may be used for cleansing after drink or a meal. The sanitizer napkin holder is lightweight, can be inexpensively manufactured, and is disposable after use. The sanitizer napkin holder encourages cleansing prior to drink or meals, either at home or in commercial establishments. In commercial usage, it encourages repeat customers. The sanitizer napkin holder is also a useful device for institutional use, especially when a washroom trip is either undesirable or impossible due to physical constraints.

The sanitizer napkin holder may be presented in a plurality of colors, shapes, or designs, or even featured with a logo or artwork. It may be comprised of paper, plastic, treated paper, foil, or a combination of materials deemed suitable. The towellette inside is folded and, when unfolded, about the size of a standard tissue.

Thus has been broadly outlined the more important features of the sanitizer napkin holder so that the detailed description thereof that follows may be better understood and in order that the present contribution to the art may be better appreciated.

Numerous objects, features and advantages of the sanitizer napkin holder will be readily apparent to those of ordinary skill in the art upon reading the following detailed description of presently preferred, but nonetheless illustrative, embodiments of the sanitizer napkin holder when taken in conjunction with the accompanying drawings. In this respect, before explaining the current embodiments of the sanitizer napkin holder in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the sanitizer napkin holder. It is therefore important that the claims be regarded as including such equivalent constructions insofar as they do not depart from the spirit and scope of the present invention.

A primary object, then, of the present invention is to provide a napkin holder that is versatile.

Another object of the invention is to provide a napkin holder that is basic in design.

A further object is to provide a napkin holder that provides for hand cleansing.

Yet another object is to provide a napkin holder that provides for hand disinfecting.

Still another object is to provide a napkin holder that provides antibacterial treatment.

Another object of the invention is to provide a napkin holder that prevents the spread of disease.

Another object is to provide a napkin holder that negates a trip to the washroom.

A further object is to provide a napkin holder that can be reasonably priced.

Yet another object of is to provide a napkin holder that is disposable.

Still another object is to provide a napkin holder that is compact in size.

Another object of the present invention is to provide a napkin holder that is lightweight.

Another object is to provide a napkin holder that is flexible.

A further object of the is to provide a napkin holder that encourages users to cleanse prior to eating or drinking.

Yet another object is to provide a napkin holder that encourages users to cleanse after eating or drinking.

Still yet another object is to provide a napkin holder that encourages use by children.

Another object is to provide a napkin holder that encourages customer return.

Another object of the invention is to provide a napkin holder that can be used for a multitude of cleansing needs.

Still another object is to provide a napkin holder that is decorative.

A further object of the invention is to provide a napkin holder that can incorporate colorful presentation.

Yet another object is to provide a napkin holder that can incorporate a multitude of designs.

Further, it is an object to provide for a napkin holder that may be produced in a plurality of shapes.

It is an added object to provide for a napkin holder that may be produced in a plurality of sizes.

Still another object of the invention is to provide a napkin holder whose cleansing feature is easy to use.

Another object is to provide a napkin holder that is inexpensive.

An added object of the present invention is to provide a napkin holder that contains a pocket.

These together with additional objects of the sanitizer napkin holder, along with various novel features that characterize the invention are particularly pointed out in the claims forming a part of this disclosure. For better understanding of the sanitizer napkin holder, its operating advantages and specific objects attained by its uses, refer to the accompanying drawings and description.

DETAILED DESCRIPTION OF THE PREFERRED EMBODIMENT

With reference now to the drawings, and in particular FIGS. 1 through 5 thereof, the preferred embodiment of the sanitizer napkin holder employing the principles and concepts of the present invention and generally designated by the reference number 10 will be described.

Figure 1:
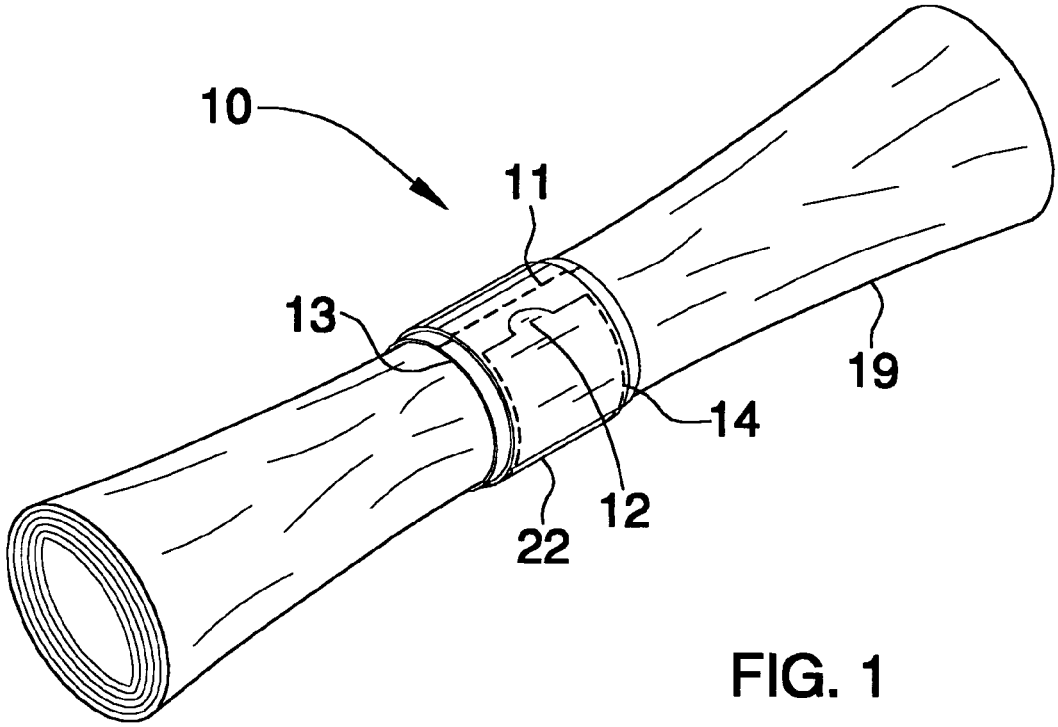
FIG. 1 is a perspective view of the invention on a napkin.
Figure 2:
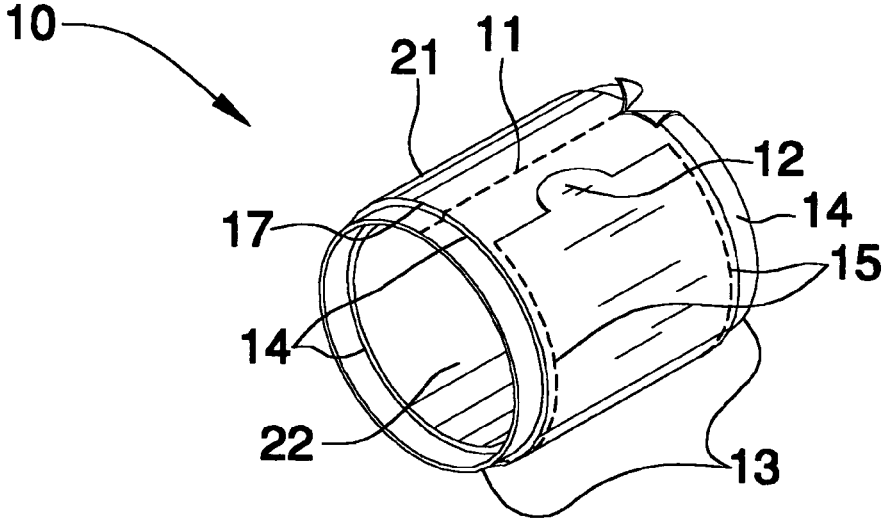
FIG. 2 is a perspective view of the invention.

Referring now to FIG. 1, the invention 10 comprises sanitizer napkin holder 10, specifically said napkin holder 10 of a ring shape. Said ring is formed of an elongated strip formed of a flexible material. Said strip has a pair or lateral edges 13 extending circumferencially around said ring in a line perpendicular to a napkin 19 held within. Said edges 13 further define a strip width therebetween. A pocket 17 is disposed within said strip width, and said pocket is further defined by pocket borders 14 on the outer edges of said pocket, said borders circumscribing invention 10 parallel to said edges 13. Medially within and proximal to said borders 14 are parallel tear lines 15. Tear lines 15, in the preferred embodiment, circumscribe holder 10 to aid opening of said pocket. Outer pocket surface 21 and inner pocket surface 22 further comprise said pocket 17. Said tear lines 15 selectively allow the removal of substantially all of said outer surface 21. Protruding from one end of said outer surface 21 is pull-tab 12. Said pull-tab 12 is formed of a semicircular half moon shape extension of outer surface 21 of pocket 17. The invention 10 further provides a perforated separation line 11. Line 11 is perpendicular to said circumference of said ring, thereby providing for a tearable parting of said invention 10.

Figure 3:
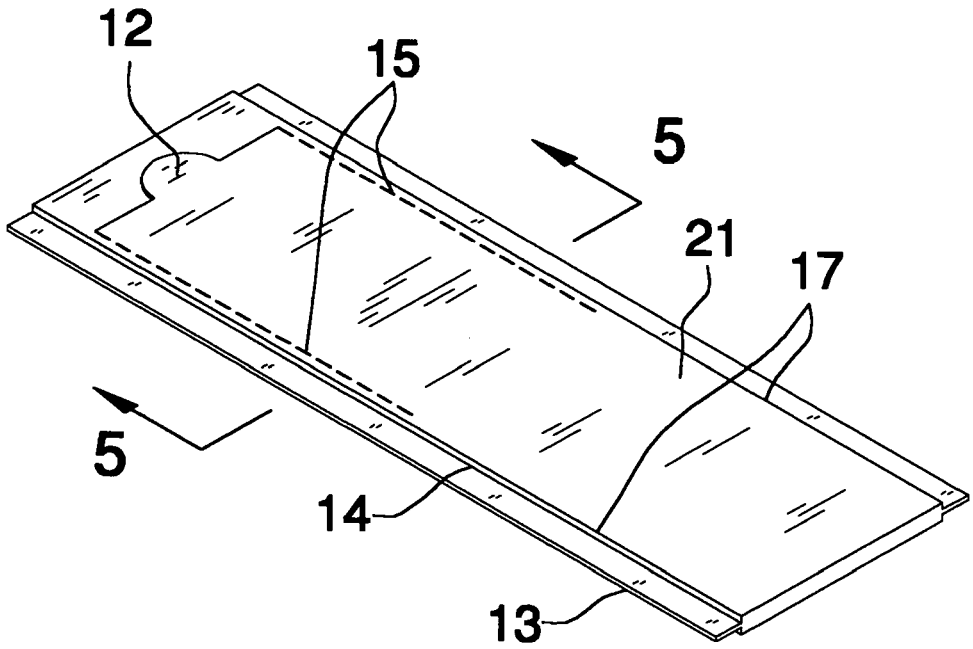
FIG. 3 is a perspective view of the invention separated at its tear line.
Figure 4:
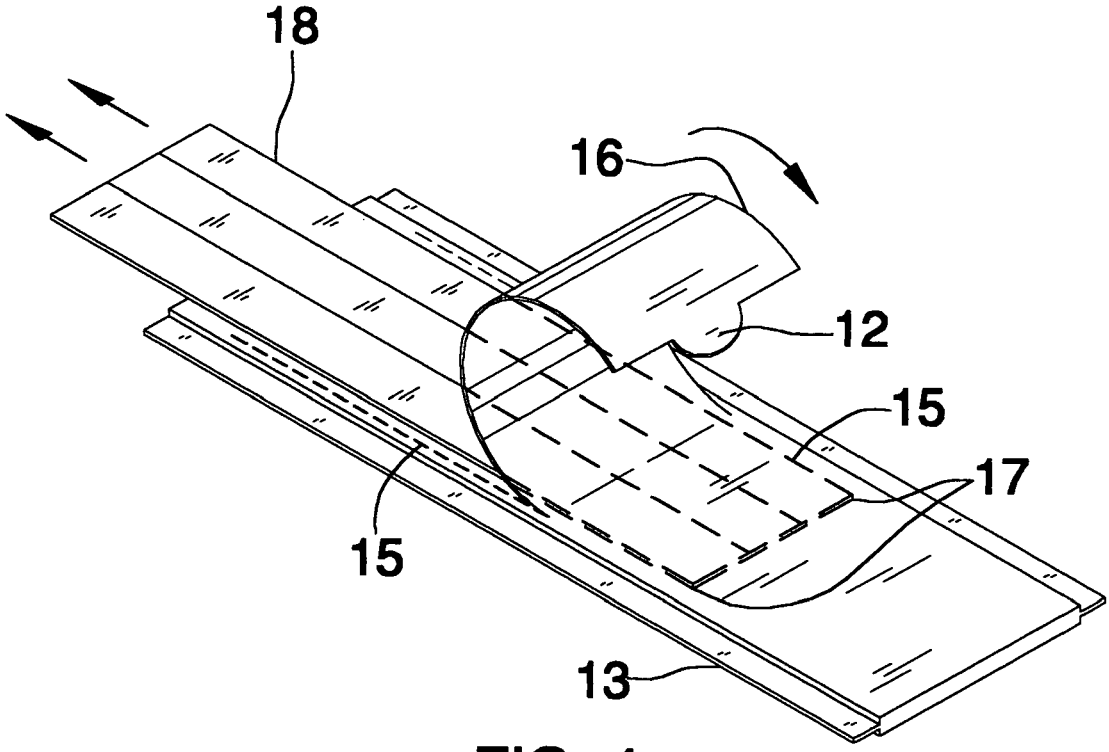
FIG. 4 is a perspective view of the invention with pre-moistened towellette exposed.
Figure 5:
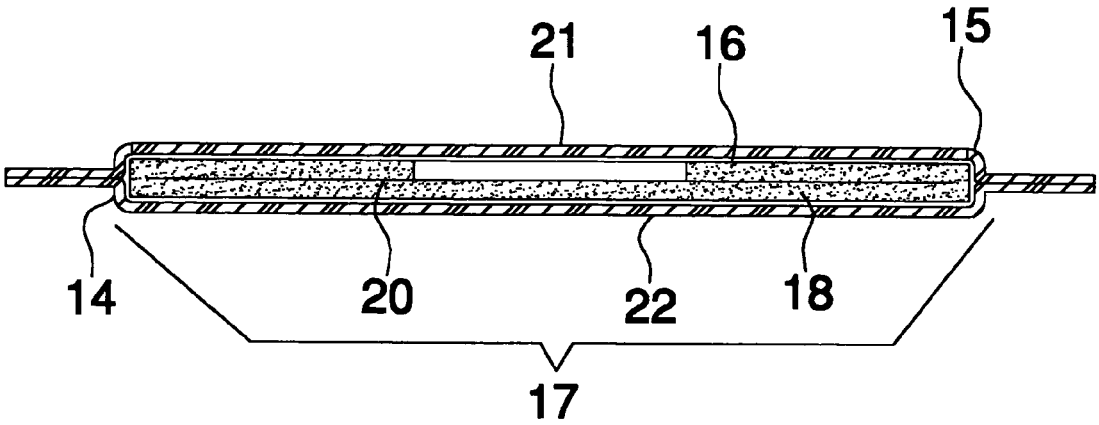
FIG. 5 is a lateral cutaway of the invention.

Referring now to FIGS. 3 and 4, the invention 10 is shown in its separated state. Referring specifically to FIG. 4, pull-tab 12 is shown utilized, with tear lines 15 partially torn back to access pre-moistened towellette 18 which has been partially removed from pocket 17. Towellette 18 is further defined as a small, disposable, folded towel saturated with sanitizing liquid. Moisture proof pocket lining 16 prevents moisture from towellette 18 from escaping pocket 17. Towellette 18 is shown folded in FIGS. 4 and 5. Towellette fold 20 illustrates the folded state of towellette 18 as it resides within pocket 17.

With respect to the above description then, it is to be realized that the optimum dimensional relationships for the parts of the sanitizer napkin holder, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sanitizer napkin holder comprising:

a napkin ring formed by attachment of the ends of a flexible elongated strip, said strip having a pair or lateral edges extending circumferentially around said ring to define a strip width therebetween; and a perforated separation line extending from one lateral edge to the other lateral edge of said ring, a moisture proof pocket disposed within said strip width, said pocket is defined by an inner surface, an outer surface and outer pocket borders circumscribing said ring; and a means for opening said pocket; and a pre-moistened towellette removably contained within said pocket.

2. The sanitizer napkin holder in claim 1 wherein:

said means for opening said pocket further comprises a pull-tab protruding from one end of said outer surface of said pocket.

3. The sanitizer napkin holder of claim 2 wherein said opening means further comprises a tear line medially within and proximal to said outer pocket borders, whereby said tear line allows for said outer surface of said pocket to be readily disengaged from said ring and allowing access to said pre-moistened towellette removably contained within said pocket.

4. The sanitizer napkin holder of claim 1 wherein said pre-moistened towellette further comprises an anti-bacterial agent.

5. The sanitizer napkin holder of claim 1 wherein the pre-moistened towellette further comprises an anti-fungal agent.

6. The sanitizer napkin holder of claim 1 wherein said ring is produced in a plurality of colors.

7. The sanitizer napkin holder of claim 1 wherein said ring comprises designs or logos incorporated onto an exposed side of said ring whereby said ring is thereby customized to the needs of an specific user.

8. A sanitizer napkin holder comprising:

a napkin ring formed by attachment of the ends of a flexible elongated strip, said strip having a pair or lateral edges extending circumferencially around said ring to define a strip width therebetween;

a moisture proof pocket disposed within said strip width, said pocket further comprised of an inner surface and an outer surface and outer pocket borders circumscribing said ring; and a means for opening said pocket comprising a pull-tab protruding from one end of said outer surface of said pocket;

a tear line medially within and proximal to said outer pocket borders, whereby said tear line allows for said outer surface of said pocket to be readily disengaged from said ring and allowing access to said cleansing means contained within said pocket, cleansing means removably contained within said pocket.

9. A sanitizer napkin holder comprising:

a napkin ring formed by attachment of the ends of a flexible elongated strip, said strip having a pair or lateral edges extending circumferencially around said ring to define a strip width therebetween, said ring of any of a plurality of colors;

a moisture proof pocket disposed within said strip width, said pocket further comprised of an inner surface and an outer surface and outer pocket borders circumscribing said ring;

a tear line medially within and proximal to said outer pocket borders, whereby said tear line allows for said outer surface of said pocket to be readily disengaged from said ring and allowing access to said cleansing means contained within said pocket;

a perforated separation line extending from one lateral edge to the other lateral edge of said ring;

a pull-tab protruding from one end of said outer surface of said pocket, the pull tab disposed at the perforated separation line extending from one lateral edge to the other lateral edge of said ring;

a pre-moistened towellette removably contained within said pocket, said towellette comprising both cleansing and disinfecting agents;

means for selectively separating said ends of said ring;

designs or logos incorporated onto an exposed side of said ring whereby said ring is customized to the needs of an specific user.

* * * * *